United States Patent [19]

Klock et al.

[11] 4,420,158

[45] Dec. 13, 1983

[54] PORTABLE SPORTS FIELD GOAL ASSEMBLY

[75] Inventors: Lawrence E. Klock, Spokane; Randall J. Broweleit, Renton, both of Wash.

[73] Assignee: Soccer Stuff, Inc., Seattle, Wash.

[21] Appl. No.: 307,801

[22] Filed: Oct. 2, 1981

[51] Int. Cl.[3] ..... A63B 63/00

[52] U.S. Cl. ..... 273/400; 273/127 B; 248/156

[58] Field of Search ..... 273/398–402, 273/181 F, 26 A, 127 R, 127 B, 1.5 R; 248/156

[56] References Cited

U.S. PATENT DOCUMENTS

| | | | |
|---|---|---|---|
| 1,405,081 | 1/1922 | Whitney | 273/181 F |
| 1,879,220 | 9/1932 | Harmony | 248/156 X |
| 2,077,343 | 4/1937 | Oakes et al. | 273/127 B |
| 2,922,653 | 1/1960 | O'Brien | 273/181 F |
| 3,286,962 | 11/1966 | Warth | 248/156 X |
| 3,527,355 | 9/1970 | Boyer | 248/156 X |
| 3,823,785 | 7/1974 | Toliver | 248/156 X |
| 4,242,822 | 1/1981 | Black | 248/156 X |

FOREIGN PATENT DOCUMENTS

| | | | |
|---|---|---|---|
| 1910844 | 9/1970 | Fed. Rep. of Germany | 273/400 |
| 2353052 | 4/1975 | Fed. Rep. of Germany | 273/1.5 R |

*Primary Examiner*—Paul E. Shapiro

*Attorney, Agent, or Firm*—Wells, St. John & Roberts

[57] ABSTRACT

A portable sports field goal assembly and framework includes an elongated net with a peripheral rope frame that may be secured to portable end frames. The end frames are made up of at least two releasably interconnected support members that can be secured in upright positions along the ground surface by ground cup assemblies and by guy cord assemblies. Lengths of the rope frame may extend through openings along the support assemblies. The rope lengths are knotted to secure the net corners to the frames. The ground cup assemblies each include an upwardly open cup with a central opening in its bottom horizontal wall. The openings receive headed spikes that may be driven into the ground to secure the cup against the ground surface. The cups also include access openings that receive lengths of the rope frame to be looped over the headed ends of the spikes. The rope frame can thereby be secured by the spikes to the ground and the supporting general framework.

7 Claims, 10 Drawing Figures

PORTABLE SPORTS FIELD GOAL ASSEMBLY

BACKGROUND OF THE INVENTION

The present invention relates to ground supported portable sports field goal structures and mechanisms for securing such structures to the ground surface.

The sport of soccer is played on a 120 yard field between opposing goals on either end. Each consists of a frame and a net. The frame is rectangular in shape and is customarily constructed of heavy wooden beams or steel pipe permanently embedded in the ground. The net is attached to the sides, top and back of the frame.

The permanency of the standard soccer goal and net limits its use to only those fields where such frames can be mounted. Movable goals of rigid, bulky girth are also available but are heavy and difficult to transport to various playing fields. Additionally, they are not readily disassembled or folded.

Other outdoor games also involve the use of a goal or net structure situated at opposite ends of a playing field. Availability and practicality of portable goals for such sports has also been a problem.

Part of the difficulty with portable net structures, especially in portable soccer nets, is the failure of the net frame assembly to provide adequate means for attachment to the ground surface that will facilitate removal, folding and storage. Many structures rest directly on the ground surface without being anchored by spikes or guying mechanisms. Others are secured but with heavy ground sleeves that are very difficult to remove from the playing field when the goal is to be folded and stored.

An example of a portable soccer goal is found in the "Brine" catalog of Aug. 17, 1978. Brine discloses, under item 9, page 13, a portable soccer goal having "ground sleeves" for securing the goal "end frames" into position. It is not disclosed, but assumed, that the "ground sleeves" are to be driven by a heavy hammer or sledge into the ground, with open upwardly facing ends for slidably receiving the bottom ends of the goal end frame structures. The net is draped over the assembled frame members and is attached by "ground anchors" to the ground surface. Such "ground anchors" typically resemble tent stakes, being driven into the ground and having hooked upper ends for attachment to the net structure.

It is understood that such "ground sleeves" are often left in place permanently once positioned, due in part to the difficulty in pulling them back up. The "portable" goal then becomes the remainder of the tubular frame and net. Another difficulty experienced with "ground sleeves" is that they must be driven to a precise depth in order to locate the net top at regulation height above the ground.

U.S. Pat. No. 4,127,171 to Pennell discloses a portable soccer goal in which a net is stretched across a frame made up of two collapsible triangular end members and an interconnecting overhead cross bar. It appears that the net is secured to the frame in a relatively conventional manner, by tying the ends of the net webbing to the cross bar, then draping the opposed net ends over the end frames. The triangular end members include horizontal base sections that rest against the ground surface when the goal is in use. There doesn't appear to be any apparatus disclosed for otherwise securing the frame to the ground.

U.S. Pat. No. 4,116,446 to Thompson discloses a multi-function net arrangement that can be assembled in the configuration of a soccer goal or a volleyball net. Collapsible frame members are disengageable to permit assembly in the different configurations. Upright stakes can be driven into the ground, then fitted with elongated extensions as the primary supports for the volleyball net configurations. A cross bar and angle braces are added for the soccer goal configuration. The net is attached to the uprights and cross bar by clips.

U.S. Pat. No. 4,045,032 to Cox discloses a practice net arrangement in which only two spaced upright poles are used to support a net. The uprights are attached to the net by pin and grommet arrangements. The bottom ends of the poles simply rest against the ground.

The "portable" structures described above that include "cross bars" may have the capability of being folded and carried from place to place. However, they are cumbersome due to the length of the cross bar and are therefore difficult to transport without a truck or station wagon. The remaining arrangements, not having cross bars, would be unstable for use in regulation size goals.

The present invention involves a lightweight, portable arrangement which folds quickly from an operative condition to a compact storage condition and that can be easily transported in an automobile to any practice field. Reassembly can be accomplished by one person, resulting in a regulation size net that will hold securely in position without need of a rigid cross bar extending between end frames of the goal frame structure. The unit is entirely portable, yet can be securely affixed to the ground surface by provision of unique ground cup assemblies that secure the frame to the ground and the net to the frame.

BRIEF DESCRIPTION OF THE DRAWINGS

The present invention is illustrated in the accompanying drawing in which.

DETAILED DESCRIPTION OF PREFERRED AND ALTERNATE EMBODIMENTS

Figure 6:
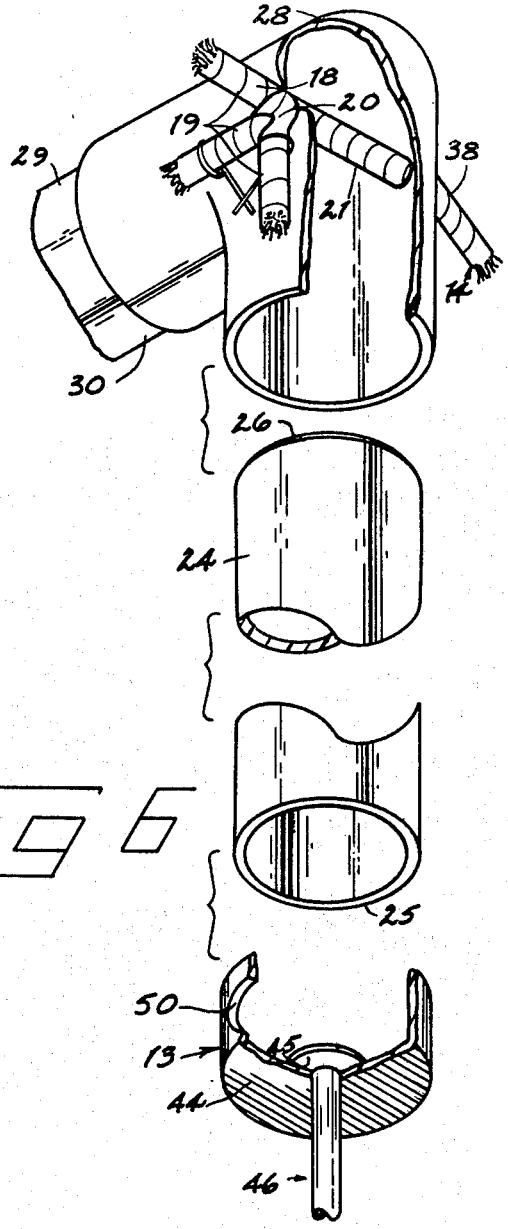
FIG. 6 is an exploded fragmentary view of the end frame for the arrangement shown in FIGS. 1 and 5.
Figure 8:
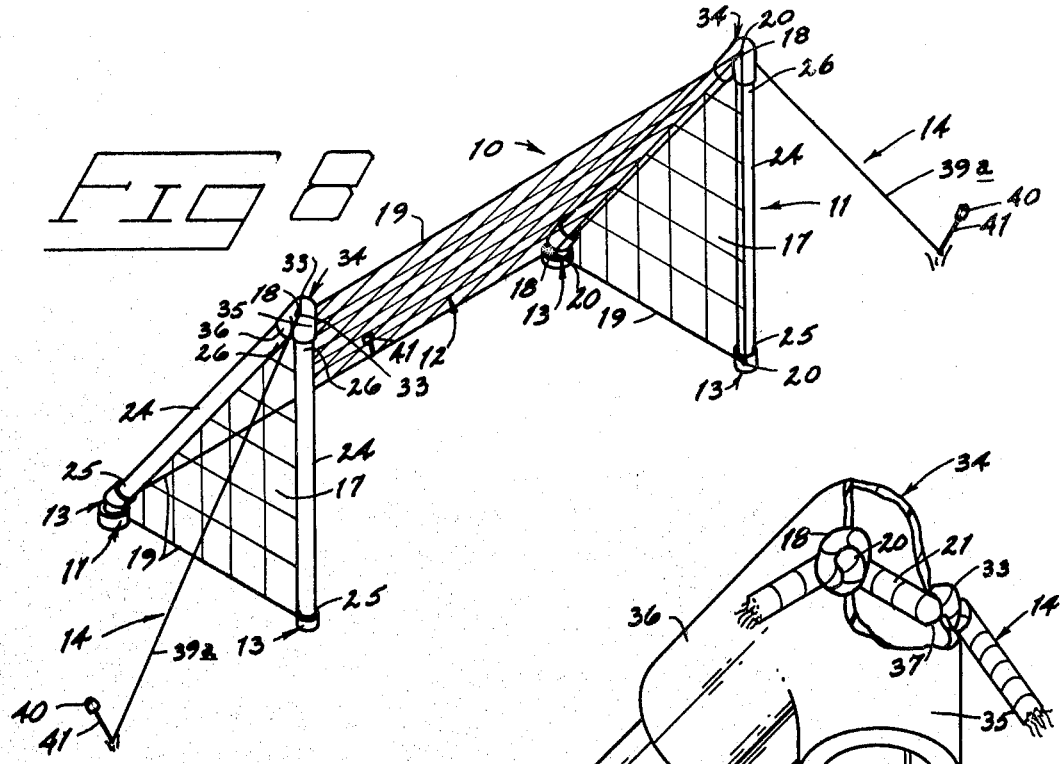
FIG. 8 is a pictorial view of an alternate configuration of the present invention.
Figure 9:
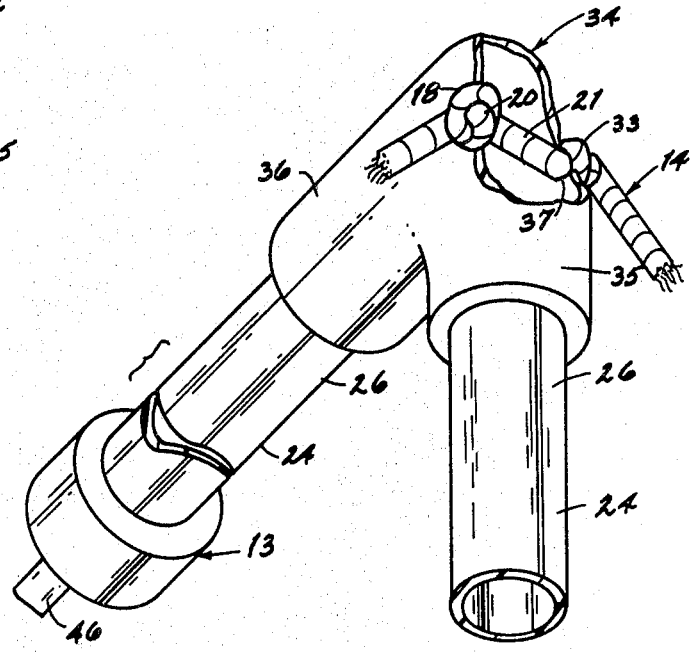
FIG. 9 is a detailed view of a joint for the alternate arrangement shown in FIG. 8.
Figure 10:
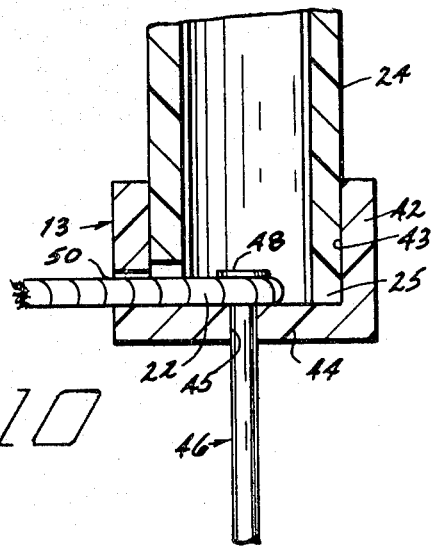
FIG. 10 is a sectional detail showing features of the present ground cup assembly.

FIGS. 1, 3 and 4 through 7 show one form of the present portable sports field goal and frame assembly. An alternate form is shown in FIGS. 8 and 9. A ground support cup assembly, useful in both forms of the goal assembly, is shown in FIGS. 2, 6 and 10.

Figure 1:
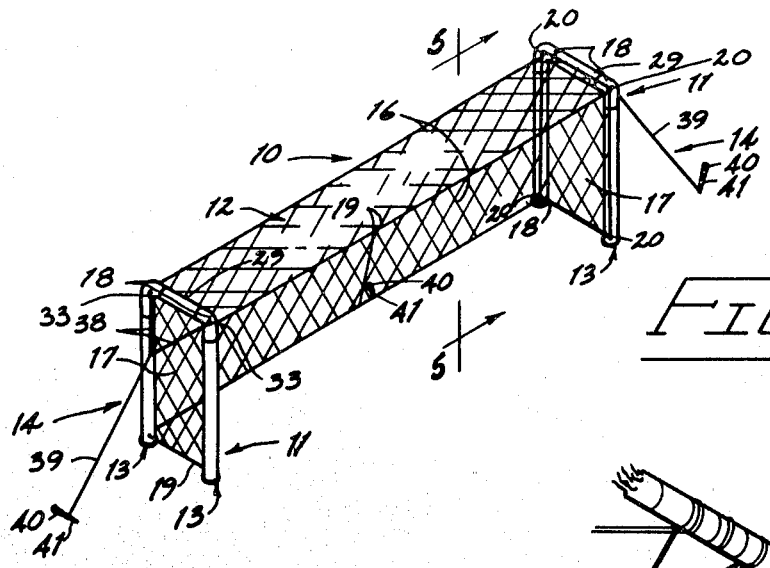
FIG. 1 is a diagrammatic pictorial view of the present invention, used as a soccer goal.
Figure 2:
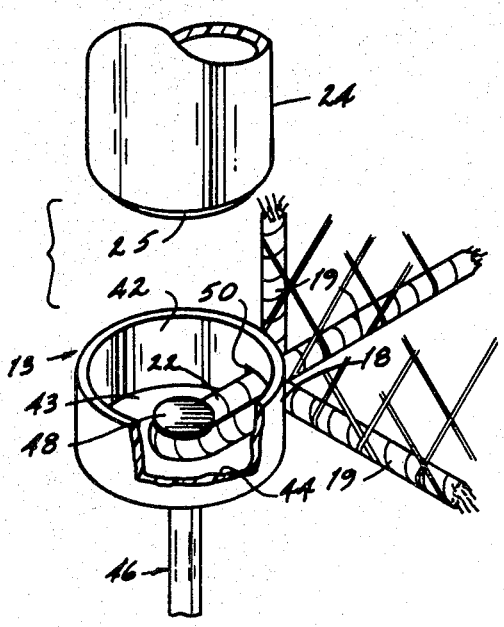
FIG. 2 is an exploded fragmentary view showing a ground cup arrangement.

FIGS. 1 and 8 show two goal forms that can be used for soccer play. Both forms are designated in the drawings generally by the reference numeral 10. Specific differences between the two embodiments will be discussed in detail below. However, either form can be used as a field goal for any of several sporting events, such as soccer.

Both goal configurations shown in FIGS. 1 and 8 include opposed end frames 11. The end frames 11 support elongated nets 12 in a taut, rectangular configuration. Guy means 14 are provided at opposed ends of the nets, operatively connected to each of the end frames. The guy means are adapted to be secured to the ground surface in order to hold the frames 11 in upright operative positions with the net stretched between. Ground cup arrangements 13 serve both to hold the end frames securely to the ground surface and to hold the net securely to the end frames.

The nets 12 as briefly discussed above are rectangular, having longitudinal sides 16 and transverse ends 17. The sides and ends are joined at corners 18. The periphery of the net is defined by a rope frame 19 that is sewn or otherwise attached to the net. Knots 20 are formed along the length of the frame at the corners 18. The rope 19 also includes a number of extending lengths 21 (FIG. 4) and 22 (FIGS. 2 and 10) that are used along with the knots 20 for attaching the net to the end frames and for use as guy means 14.

The end frames 11 are formed by releasably interconnected support members 24. The members 24 are elongated, with base ends 25 and top ends 26. The support members are preferably constructed of a readily available lightweight synthetic tubular material such as polyvinylchloride (PVC) pipe.

Both forms of the goal 10 make use of support members 24. However, the configuration shown in FIG. 1 includes interconnecting elbows 28 and horizontal cross pieces 29 for joining the support members together. The support members and cross pieces 29 form inverted "U" shapes. The net is attached to the horizontal cross pieces 29 and to the support members 24 to form a forwardly open goal configuration.

Figure 3:
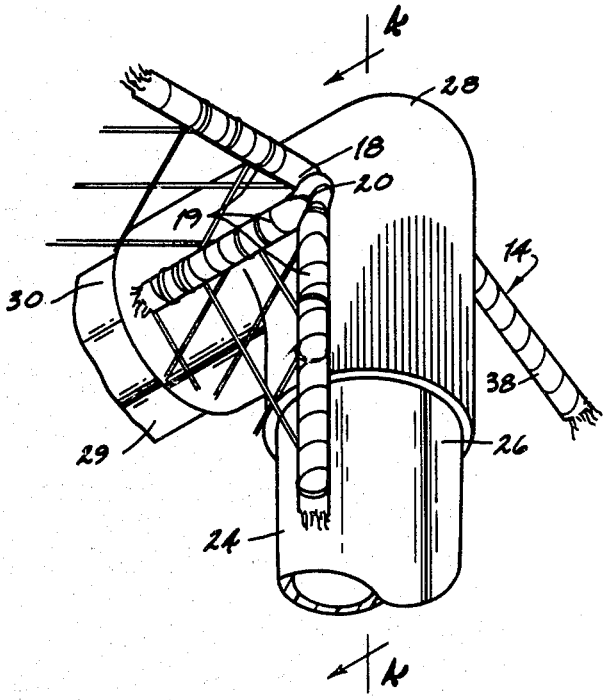
FIG. 3 is a fragmentary pictorial view of an elbow fixture at an upper corner of the goal arrangement.

FIGS. 3 and 6 illustrate one of the elbow members 28 and its connection between a horizontal cross piece 29 and one of the support members 24. The elbow 28 is mounted to the top end 26 of a support 24 and includes a horizontally extending flange for receiving an end 30 of a cross piece 29.

Figure 4:
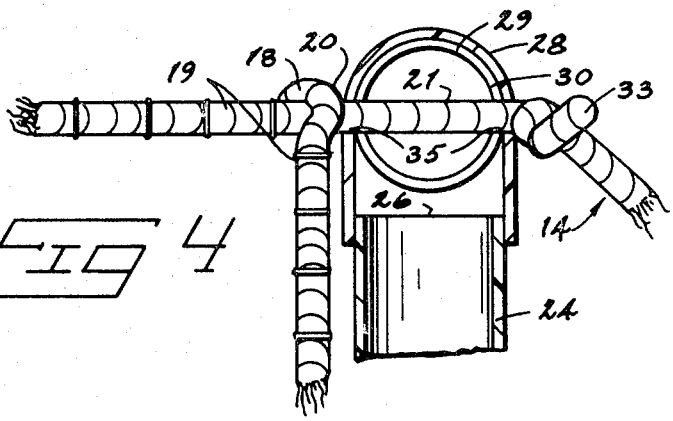
FIG. 4 is a sectional view taken along line 4—4 in FIG. 3.
Figure 5:
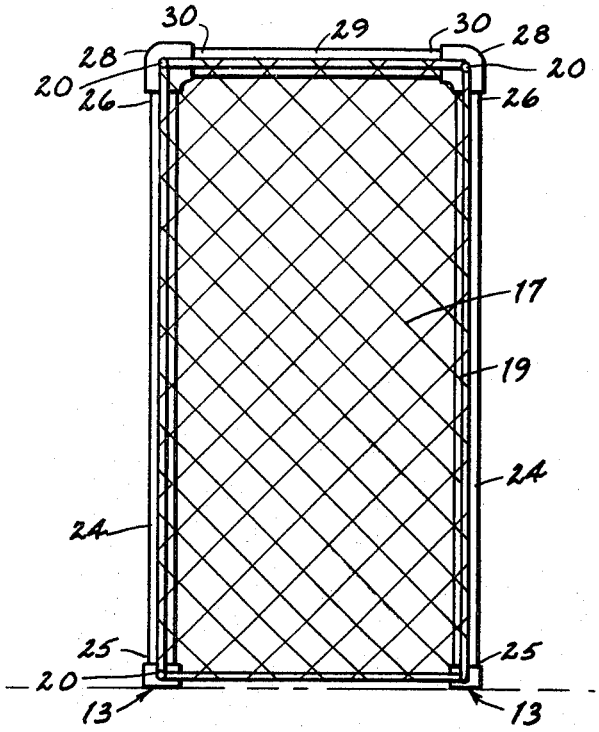
FIG. 5 is an enlarged sectional view taken along line 5—5 in FIG. 1.

FIG. 4 illustrates side openings 35 extending through the elbows 28 for receiving appropriate rope lengths 21. Knots 20 along the lengths 21 are pulled against surfaces of the elbows at the openings 31 and second knots 33 are tied on the opposite sides of the elbows in order to secure the rope frame to the elbow joints.

The goal arrangement illustrated in FIG. 8 makes use of inverted "V" joints 34 with each having one of its legs 35 upright and joined to an upright support member 24 and a remaining leg 36 releasably receiving the top end 26 of the remaining support member. The "V" joints 34 each include openings 37 that are similar in configuration and in function to the openings 31 through the elbows 28. The rope frame 19 is tied in the same manner to the V-shaped joints 34 by knots 20, 33 tied along the lengths 21 against surfaces of the joints.

In the embodiment illustrated in FIGS. 8–10 the net 12 stretched between the frames is inclined, leading from the ground surface up and forwardly to the joints 34. The open front side of the goal is then defined by the upright supports and the rope frame stretched between the joints 34.

Guy means 14 is shown in two configurations in FIGS. 1 and 8. In FIG. 1, the guy means 14 is comprised of two "Y" shaped cord assemblies, each having diverging segments 38 connected at ends to the elbows 28. Elongated segments 39 extend from the diverging segments to free ends 40 that are adapted to be secured to the ground surface by spikes 41. Preferably the guy means 14 is an integral part of the rope frame. The extending rope lengths 21 are integral with the diverging cord assembly arms 37. Alternatively the guy means 14 may be separate from the rope frame 19.

The "Y" shaped guy arrangement provides for spikes 40 to be secured well behind the front opening of the goal net to minimize the chance that a player will run behind the net opening and trip or stumble over the guy cord or spikes.

The guy cord arrangement shown in FIG. 8 is comprised simply of elongated lengths of cord **39*a* or extensions of the rope frame lengths 21 secured to the ground by spikes 41. The end frames 11** are braced by the inclined support members so the guys can be situated rearwardly of the goal opening. Tension along the guy members then pulls the upright members back against the inclined bracing support members.

There may be an extra spike 41 provided to hold down the midsection of the net 12 between the end frames. All exposed spike heads are preferably covered with protective caps 40 for safety purposes.

The ground cup arrangements 13 are shown in detail in FIGS. 2, 6 and 10. The ground cups 13 are each provided with upright cylindrical side walls 42, defining an upwardly open recess 43. The recess 43 is shaped to releasably receive the base end 25 of a support member 24. The recess 43 is closed by a horizontal bottom 44. Each bottom 44 includes an opening 45 formed between inner and outer horizontal surfaces **44*a* and 44*b*. Opening 45 receives a spike means 46. The spike means 46** cooperates with the ground cups for securing the ground cups and the attached frame members to the ground surface.

The openings 45 are sufficiently large to slidably receive shanks 47 of the spikes 46. The spikes 46 include enlarged headed ends 48 of diameters larger than the openings 45. The spikes can be driven into the ground to urge the cups downwardly as the heads 48 press against the horizontal bottoms 44. The cups 13 are therefore secured to the ground surface and also securely hold the engaged support members 24 in position.

The individual ground cups 13 are supplied with a side opening 50 formed through the upright side wall 42 directly adjacent to the horizontal bottom 44. The openings 50 receive the rope lengths 22 so they can be secured under the spike heads 48 and thereby securely attached to the frame members.

The ground cup and spike assemblies have several distinct advantages. The spikes hold the ground cups and net secure to the ground. The assemblies also hold the frame support members 24 in their selected upright positions on the ground.

Figure 7:
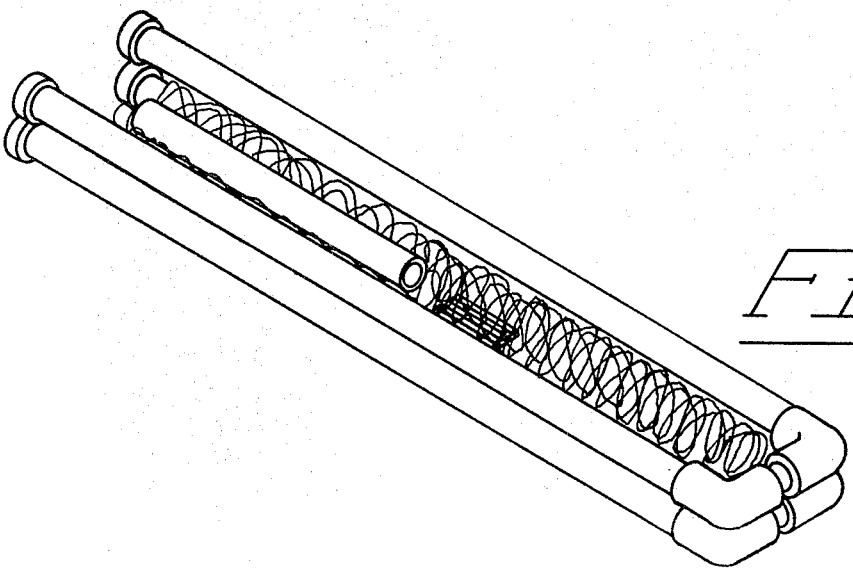
FIG. 7 is a pictorial view showing components in a storage and transport configuration.

The end frames 11, net 12, and remaining elements can be disassembled and stored or transported substantially in the condition shown in FIG. 7. It is well understood, however, that other storage configurations could be used. Assembly is a simple matter of unrolling the net, placing the ground cups and assembling the net with the end frames.

Specifically, assembly may be accomplished by a single person in several very simple steps.

Firstly, the cross pieces 29 are inserted into facing openings of elbows 28 to form the inverted U-shaped end frames.

Next, the net is spread with its open side aligned along the "goal line" of the field.

The ground cups are then staked by driving the individual stakes 41 through the loops 22 and through the bottom cup openings 45. Care is taken not to strike the cups and that the rope frame is pulled taut between all four ground cups, making certain that the forward cups are directly on the goal line.

Next, the end frames are lifted up and the free lower ends are inserted into the ground cups. The ground cups will hold the end frames in their upright orientation without further assistance.

The next step is to stake the guy means 14 to the ground using stakes 41. The guy means 14 is therefore used to hold the net taut and to secure the end frames in their upright condition.

Finally, the ground rope of the rope frame along the back side is secured by a center stake 41 and safety caps 40 are placed over the exposed spike ends. The device is then ready for play.

It is pointed out that assembly of the configuration shown in FIGS. 1 through 8 may be substantially identical, with the exception that there are no cross pieces 29 to be interconnected with the uprights. Instead, one of the support members 24 or 26 will be attached to the inverted V joint 34 of an adjacent member to form the inverted V shaped frame configuration.

Following use, disassembly is accomplished merely by reversing the assembly process. Again, this can be accomplished by one person and, if desired, the entire structure can be rolled into the net.

The compact storage and transportation configuration is facilitated by elimination of the usual cross bar that extends from one of the end frames to the other. With the present arrangement, there is no rigid support needed between the end frames 11 since the rope frame is held taut between the end frames and is held stable by the frame structure and guy means.

We claim:

1. A portable field goal assembly, comprising:

a pair of end frames, each including a pair elongated upright support members having bottom ends and interconnected by a cross member;

an elongated goal net having longitudinal sides and transverse ends joined at corners and having a peripheral rope frame defining the ends, sides and corners;

ground cups each having a peripheral wall defining an upwardly open recess for slidably receiving the bottom end of one elongated support member and having a horizontal bottom surface with a preformed aperture formed therethrough within said recess;

spike means received through the ground cup apertures for securing the ground cups and the attached frame members to the ground surface at spaced apart locations;

guy means operatively connected to the end frames adapted to be secured to the ground surface, for holding the end frames in upright operative positions with the net stretched between the end frames; and means for operatively attaching the net to the end frame and to the spike means adjacent the net ends.

2. The field goal assembly as claimed by claim 1 wherein the ground cups each include:

upright side walls defining the upwardly open recess, extending upwardly from the horizontal bottom surface, and a side opening formed through the upright side walls adjacent the bottom surface;

wherein the net attaching means includes lengths of the rope frame that extend through the side opening for attachment to the spike means when received through the bottom surface aperture.

3. The field goal assembly as claimed by claim 1 wherein each end frame of the pair is comprised of:

a cross piece having opposed ends;

elbow connectors mountable to the top ends of the elongated support members for receiving the opposed ends of the cross piece; and openings formed through the elbows for enabling the rope frame to be attached to the elbows.

4. The field goal assembly as claimed by claim 3 wherein the guy means is comprised of a pair of cord assemblies, each having a "Y" configuration with diverging segments leading to ends attached to the elbows, and with an elongated segment extending from the diverging arms to a free end adapted to be secured to the ground surface.

5. The field goal assembly as claimed by claim 3 wherein the ground cups each include:

upright side walls defining the upwardly open recess, extending upwardly from the horizontal bottom surface; and an opening formed through the upright side walls adjacent the bottom surface;

wherein the net attaching means includes lengths of the rope frame that extend through the side opening for attachment to the spike means when received through the bottom surface aperture.

6. The field goal assembly as claimed by claim 1 wherein the pairs of support members are interconnected by elbow joints at top ends thereof, forming an inverted "V" configuration with one member being upright and the remaining member inclined.

7. The field goal assembly as claimed by claim 6 wherein:

each support member includes a bottom end and a top end, with the bottom ends being releasably received by a ground cup and secured to the ground by the spike means;

first openings formed through the elbow joints;

wherein the net attaching means includes first lengths of the rope frame at selected corners thereof received through the first openings and secured to the elbow joints by knots;

second openings formed in the ground cups; and wherein the net attaching means includes second lengths of the rope frame at the remaining net corners received through the second openings and releasably secured to the spike means therein.

* * * * *